US005791555A

United States Patent [19]

Kanter

[11] Patent Number: 5,791,555

[45] Date of Patent: Aug. 11, 1998

[54] DISPLAY-READY CONTAINER ASSEMBLY AND BLANK FOR MAKING THE SAME

[76] Inventor: Allen Kanter, 1042 Gypsy Hill Rd., Gwynedd Valley, Pa. 19437

[21] Appl. No.: 794,434

[22] Filed: Feb. 5, 1997

Related U.S. Application Data

[60] Provisional application No. 60/012,875 Mar. 5, 1996.

[51] Int. Cl.[6] ..... B65D 5/02

[52] U.S. Cl. ..... 229/164; 229/157; 229/169

[58] Field of Search ..... 229/156, 157, 229/164, 169, 155

[56] References Cited

U.S. PATENT DOCUMENTS

| | | | |
|---|---|---|---|
| 2,713,965 | 7/1955 | Acker | 229/156 |
| 2,904,238 | 9/1959 | Perry et al. | 229/155 |
| 3,063,593 | 11/1962 | Kuchenbecker | 220/23 |
| 3,801,001 | 4/1974 | Taylor | 229/156 |
| 4,058,249 | 11/1977 | Buck | 229/169 |
| 4,133,474 | 1/1979 | Hall | 229/23 R |
| 4,385,721 | 5/1983 | Olsen et al. | 229/164 |
| 4,463,997 | 8/1984 | Densen | 312/259 |
| 4,537,344 | 8/1985 | Thomas . | |
| 4,613,045 | 9/1986 | Watson | 229/169 |
| 4,702,409 | 10/1987 | Osborne | 229/169 |
| 4,979,666 | 12/1990 | Zion et al. | 229/164 |
| 5,183,200 | 2/1993 | Okamoto | 229/23 R |
| 5,201,461 | 4/1993 | Sykora | 229/125.08 |
| 5,337,950 | 8/1994 | Bower | 229/164 |
| 5,415,344 | 5/1995 | Harrelson | 229/169 |
| 5,489,061 | 2/1996 | Fogle et al. | 229/109 |
| 5,524,815 | 6/1996 | Sheffer | 229/157 |

FOREIGN PATENT DOCUMENTS 2 220 406 1/1990 United Kingdom .

*Primary Examiner*—Gary E. Elkins
*Attorney, Agent, or Firm*—Synnestvedt & Lechner

[57] ABSTRACT

A container having a shelf member disposed on the top of a side panel of the container. The shelf is further attached to an adjacent side panel of the container through a pull-down member. Assembling the container from a flat knockdown form automatically pulls the shelf into position for use in stacking such containers. A knockdown and a blank for making the container are also provided.

28 Claims, 8 Drawing Sheets

DISPLAY-READY CONTAINER ASSEMBLY AND BLANK FOR MAKING THE SAME

CROSS-REFERENCE TO RELATED APPLICATION

This application claims the benefit of U.S. Provisional Application 60/012,875, filed Mar. 5, 1996.

BACKGROUND OF THE INVENTION

1. Field of the Invention

The present invention pertains to containers and boxes used for packaging, shipping, and displaying goods. More particularly, the invention relates to display containers having means to facilitate the stacking of such containers on top of one another.

2. Description of the Related Art

Display containers are widely used for shipping and marketing products. Such containers are especially popular in warehouse-type marketing settings and supermarkets where many containers are opened to display the food or merchandise within and stacked one on top of another. Examples include containers of packaged candy which may be decorated for display purposes. The containers of candy are shipped to the store in stacked form. Store personnel remove the tops of the containers, and, in many cases, fold down a display panel which allows the candy within to be seen and removed. The containers are then stacked one on top of another on the retail floor.

A major problem with previous known display containers is their lack of strength for stacking. All too often loaded and stacked containers collapse under their own weight or become misshaped. This impairs the aesthetic appearance of the display sought by the seller, ruins the products within, and requires clean up.

Additionally, many customers prefer to purchase the entire contents of a container, or to carry the products purchased in a container removed from the stack. Collapsed or misshaped containers are neither suitable nor desirable for such use.

Methods of producing stronger containers are known. For example, double walled corrugated containers are stronger than single walled corrugated containers. This added strength, however, adds additional manufacturing costs and creates more waste product for eventual disposal.

Accordingly, one object of the present invention is to provide a stronger display-ready container.

Another object is to provide a display-ready container that is economical to produce.

A further object of the present invention is to provide a display-ready container that is easy to assemble and use.

Another object is to provide a display-ready container that can be safely stacked during shipping and display.

Additional objects, advantages and novel features of the invention will be set forth in part in the description which follows, and in part will become apparent to those skilled in the art upon examination of the following, or may be learned from making and using the invention. The objects and advantages of the invention may be realized and attained by means of the combinations pointed out in the appended claims.

SUMMARY OF THE INVENTION

The present invention provides an improved container that is assembled from a knockdown. A knockdown refers to a flat, unassembled container which can be opened and folded to form the completed container.

Broadly, the invention provides a container having multiple side panels which form the container's sides. These side panels include a first, second, third and fourth side panel. The first and second side panels are attached to each other at a first folded corner and the third and fourth side panels are connected to each other at a second folded corner. A container bottom is provided attached to the side panels. Attached to the top of the first side panel is a shelf to increase the strength of the container and help support containers stacked thereon. The container is constructed so as to automatically move the shelf into a substantially perpendicular position relative to the side panels when the container is assembled from the knockdown state.

In the knockdown state, the container has first and second flat knockdown walls attached to one another at the first and second folded corners to form a substantially flat assembly where the two knockdown walls are positioned face to face in a flat position. The first knockdown wall includes the first and fourth side panels in a substantially same plane, and the second knockdown wall includes the second and third side panels in another substantially same plane. A pull-down member attaches the shelf, connected to the first side panel, to the second side panel whereby it pulls the shelf into its substantially perpendicular position when the knockdown is assembled into the container.

The invention also provides a knockdown for forming the container described above and further provides a blank for forming the knockdown and container.

BRIEF DESCRIPTION OF THE DRAWINGS

The foregoing summary and the following detailed description may be better understood when read in conjunction with the accompanying drawings. For the purpose of illustrating the invention, two preferred embodiments are shown in the drawings. It is understood, however, that this invention is not limited to the precise arrangements shown.

DETAILED DESCRIPTION

The invention disclosed herein is a novel container. Described below are preferred embodiments particularly suited for display-ready containers used for shipping small goods and food items, and which can be stacked like trays. It is recognized, however, that the present invention can be adapted to containers used for other purposes.

Figure 1:
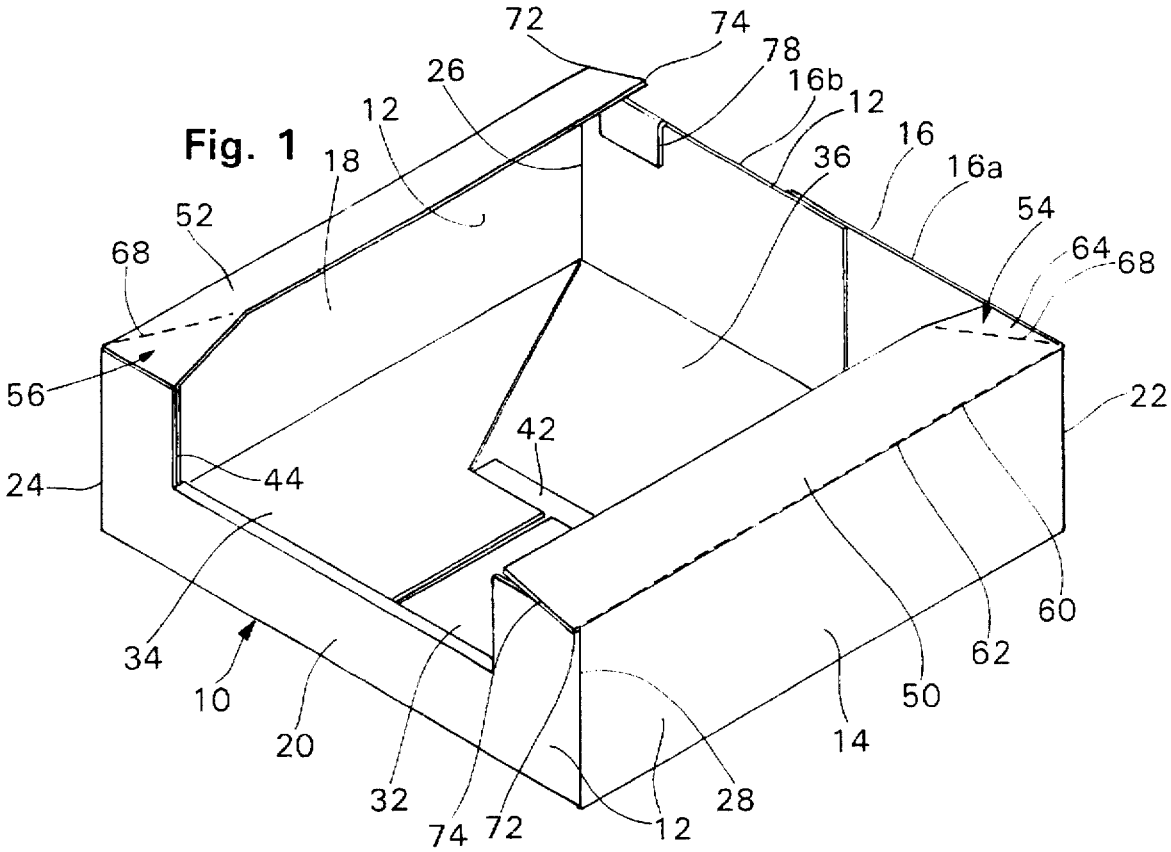
FIG. 1 is a perspective view of a container made in accordance with the present invention.
Figure 2:
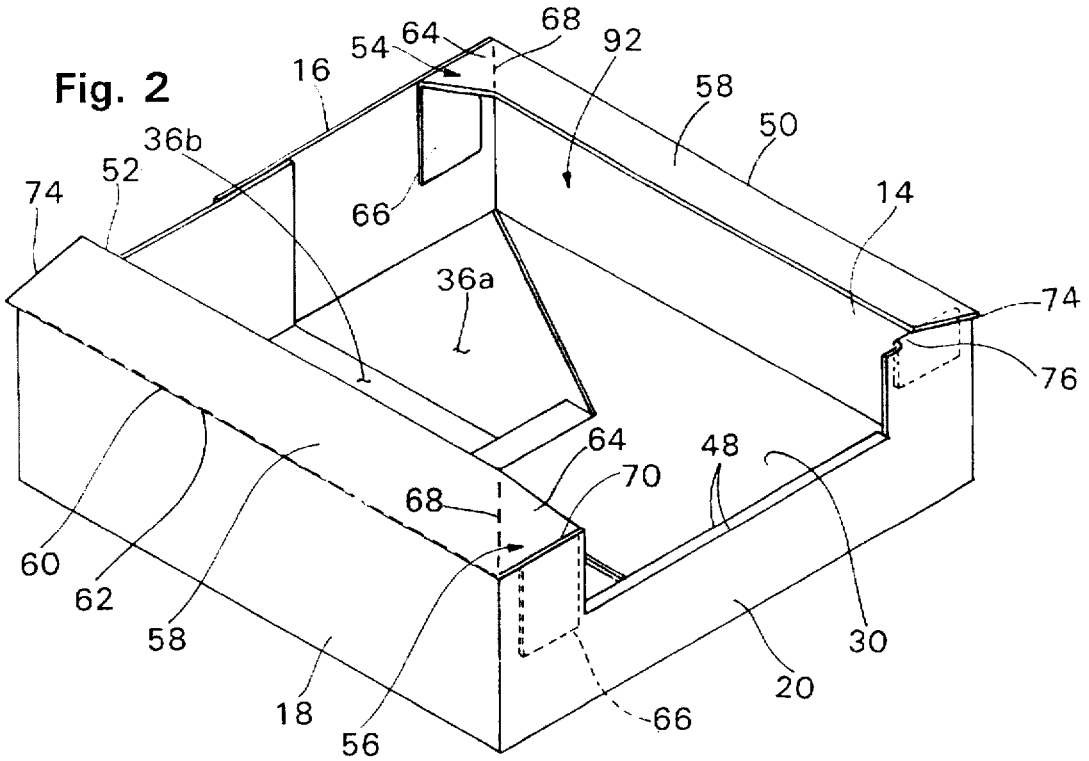
FIG. 2 is another perspective view of the container shown in FIG. 1.

Reference now will be made in detail to a preferred embodiment of the invention as illustrated in FIGS. 1 and 2 showing a display-ready container 10 for shipping and displaying goods. The container 10 has multiple side panels 12 attached to one another to form the container sides. In this particular example, the multiple panels include a first side panel 14, a second side panel 16 (the back panel), a third side panel 18 (the other side), and a fourth side panel 20 (the front panel). The second side panel 16 is formed from two partial panels 16*a*, 16*b* glued together during the manufacturing process to form the back panel 16 in a manner known in the art. The side panels 12 are attached to one another at common corners; the first and second side panels 14 and 16 at a first folded corner 22, the third and fourth side panels 18 and 20 at a second folded corner 24, and the other two corners being designated 26 and 28 as shown.

A container bottom 30 is attached to the side panels 12. Illustrated in the preferred embodiment is a "1-2-3" type bottom as known in the industry which has several interlocking flaps to form a sturdy bottom. This bottom panel 30 includes two side flaps 32 and 34 which are folded first, a back flap 36 (formed from sections 36*a* and 36*b*) having a cutout 38 (FIGS. 3 and 4), and a front flap 40 having an interlocking section 42 which locks into the cutout 38 to complete the container bottom 30. Many different types of container bottoms are known in the art such as a regular flat bottom having standard flaps, an automatic bottom also known as "crashlock", and a fold-up/tuck-up partition style bottom. Any suitable bottom style may be used.

Figure 6:
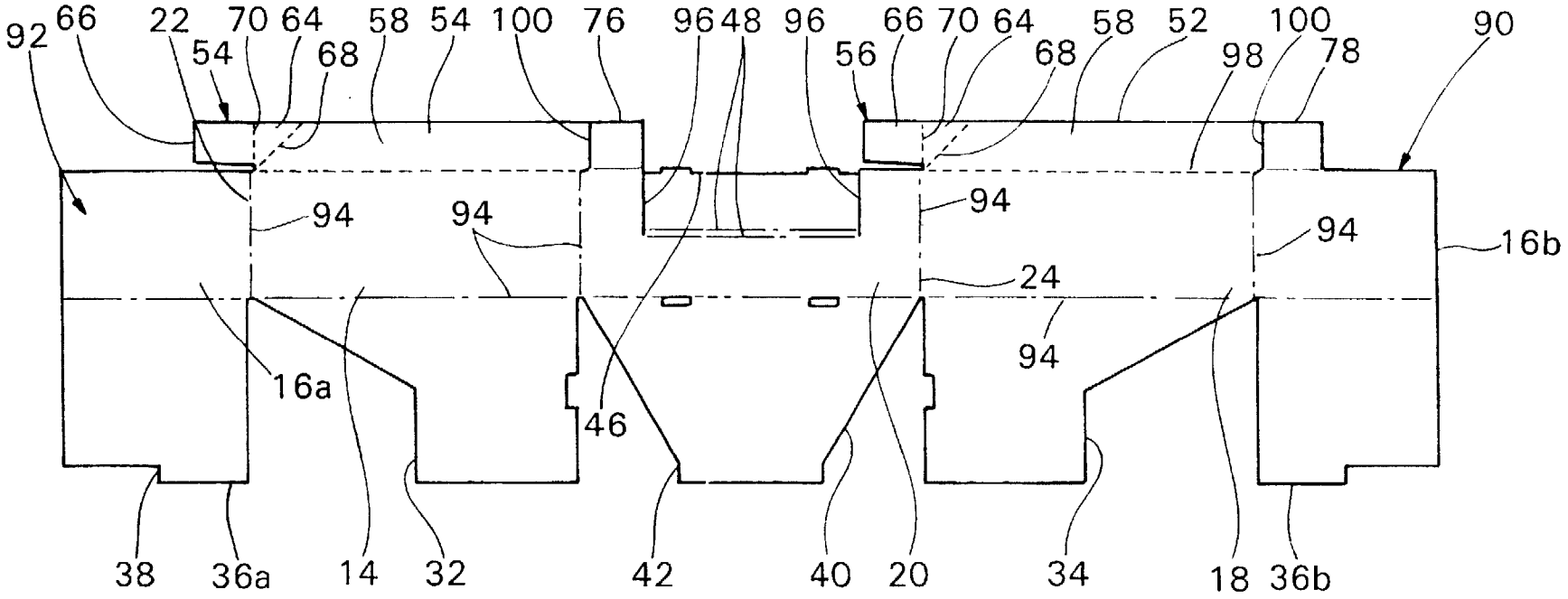
FIG. 6 is a plan view of a blank for forming the container shown in FIG. 1.

The fourth side panel 20 is shown with a display opening 44 formed by folding down rollover section 46, cut from the fourth side panel 20, along fold lines 48 (FIG. 6). The rollover section 46 is secured with glue to the inside face of the fourth side panel 20. Many different display options are known in the art and any suitable type may be used.

Along the top of the container 10 are shelves 50 and 52 which add structural strength and rigidity to the container 10 and permit the stacking of many such containers 10 one on top of another as further discussed below. An advantage of the shelf members of the present invention is that they are automatically positioned for stacking containers simply by the folding action required to convert the container from its flat, or knockdown condition, to assembled condition, in other words, by "opening" the container.

Shelf 50 is attached to (for example, by being an integral extension of) the top of first side panel 14, and shelf 52 is attached to the top of the third side panel 18. The arrangement of shelves in the present embodiment was chosen to complement this particular display container, it being recognized that the invention is not limited to this particular arrangement.

Figure 3:
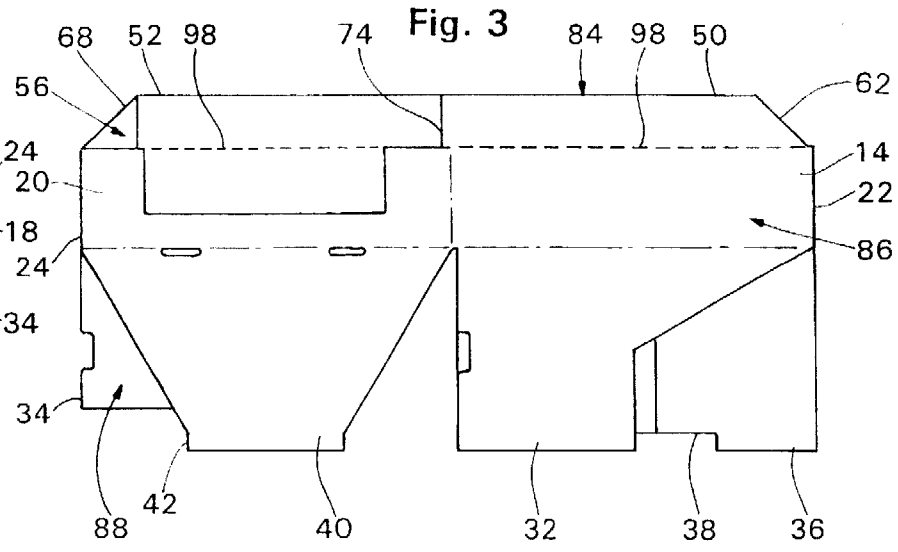
FIG. 3 is a plan view of a knockdown made in accordance with the present invention which can be assembled into the container shown in FIG. 2.
Figure 4:
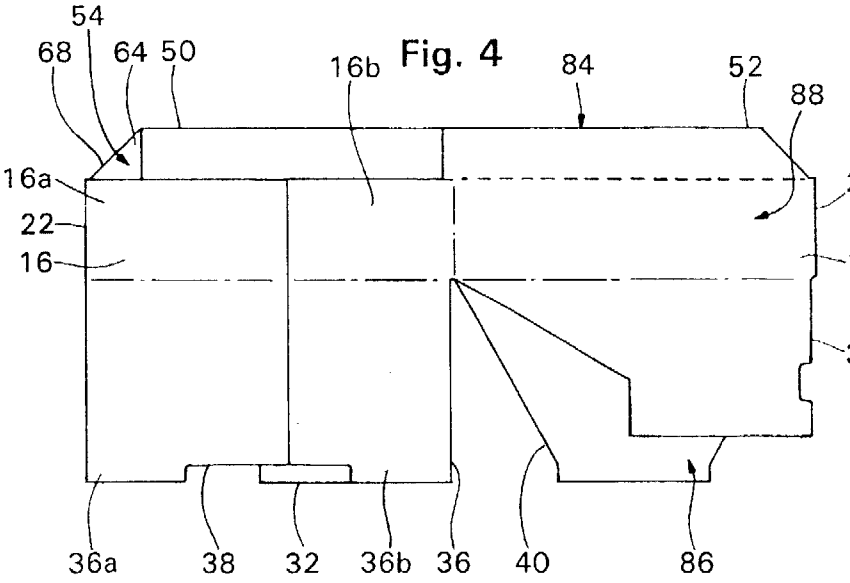
FIG. 4 is a plan view of the backside of the knockdown shown in FIG. 3.

Pull-down members 54, 56 are provided to pull respective shelf members 50, 52 into a position substantially perpendicular relative to the side panels 14 and 18 when the container 10 is assembled from the knockdown state 84 shown in FIGS. 3 and 4. "Substantially perpendicular" as used herein does not necessarily mean truly perpendicular, but means that the shelves 50 and 52 have moved towards a more perpendicular position relative to the side panels so as to serve as supporting shelves on which another container 10 can be stacked.

The pull-down member 54 attaches the shelf 50 to the second side panel 16 as best seen in FIG. 2. Likewise, pull-down member 56 attaches the shelf 52 to the fourth side panel 20.

In the present embodiment, pull-down members 54 and 56 are formed as integral extensions of respective shelf members 50, 52. Each shelf 50, 52 has a longitudinal flat section 58 attached lengthwise along its bottom 60 to the top 62 of the first and third side panels 14, 18, respectively. The pull-down member 54, as an integral extension of the shelf's flat section 58, includes a pull section 64, and a glue tab 66 which attaches to the inside face of the second side panel 16 with glue. Pull-down member 56 is similar in construction, having a glue tab 66 which attaches to the back of the fourth side panel 20. A fold line 68 (at a 45° angle relative to the end of the shelf) and fold line 70 define triangular pull sections 64 and glue tabs 66 and facilitate the set up of the container 10 from its knockdown position by allowing easy folding about the fold lines.

In the illustrated embodiment, it is seen that the pull-down members 54, 56 add strength and rigidity to the respective shelves 50, 52. The glue tab 66 secures one end of the pull-down members 54, 56 to respective side panels 16 and 20, thereby holding respective shelves 50, 52 in place.

The ends 72 (side ends) of the shelf members are shown unconnected to any side panel. Here, ends 72 include a lip 74 which extends over the top of the adjacent fourth and second side panels 20 and 16, respectively, as shown. This provides additional support to the shelves and increases the strength of the container 10.

Figure 7:
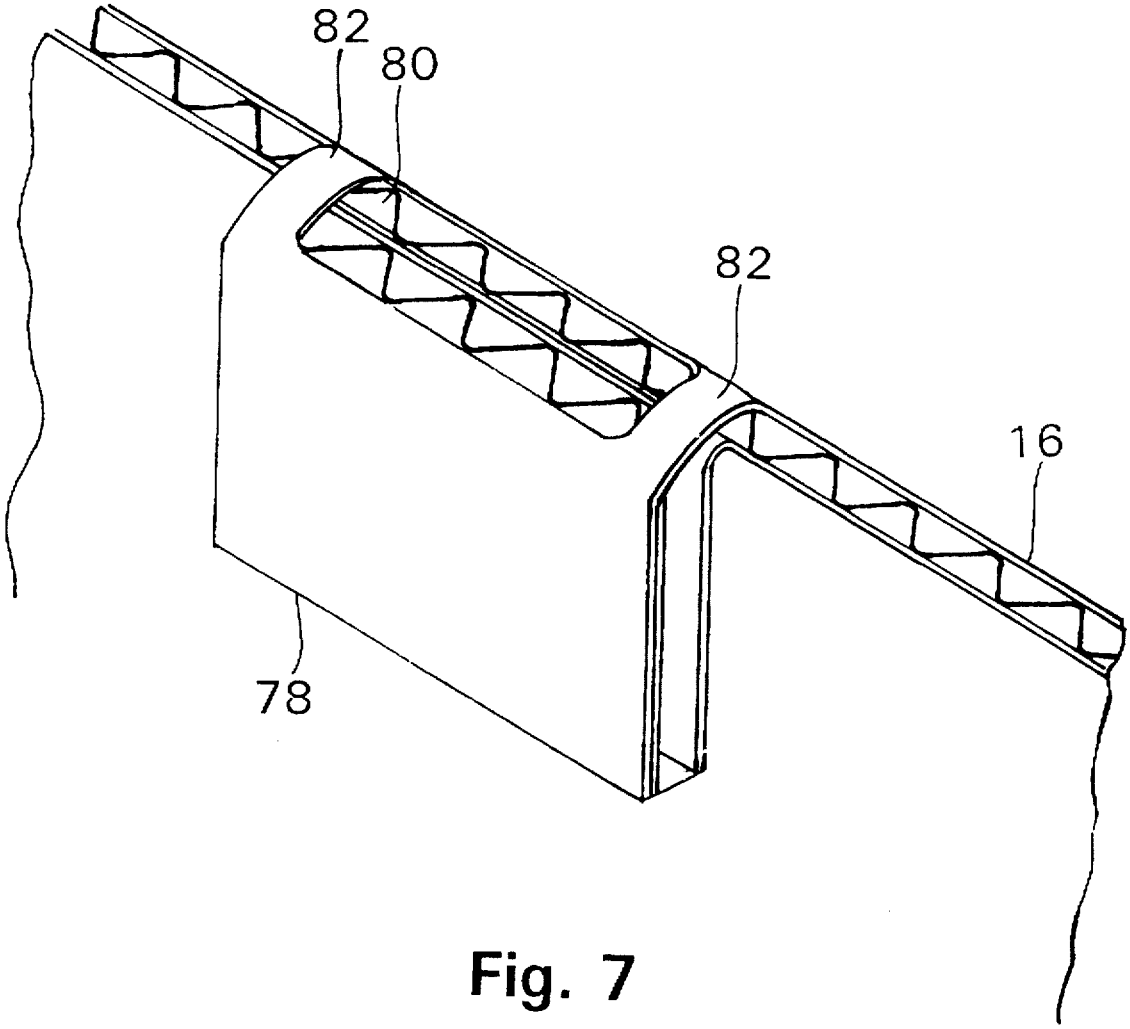
FIG. 7 is an enlarged view of the top of a reinforcing panel shown in FIG. 1.

Reinforcing panels 76 and 78 are provided to add additional strength and support to the shelves 50, 52, respectively. With reference to FIG. 7, the reinforcing panel 78 is formed as an integral extension of the second side panel 16 which is folded over as shown to form a ledge 80, and secured to the inside face of the second side panel 16 with glue. The underside of the ledge 80 is scored at the ledge ends 82 and cut between the ends 82 prior to folding. This forms a flat ledge 80 having the thickness of two wall panels. Reinforcing panel 76 is likewise formed.

A knockdown 84 which is opened and folded to form the container 10 is now described. The term "knockdown" refers to the flat unassembled assembly 84 shown in FIGS. 3 and 4, which is easily assembled into the rectangular shaped container 10 of FIGS. 1 and 2. Containers can be manufactured in the knockdown state. Because they are flat, knockdowns are conveniently bundled and shipped to the user who simply assembles the knockdown 84 into the final container 10. The knockdown of the present invention automatically moves the shelf members 50, 52 into proper position for stacking while increasing the strength of the container.

Figure 5:
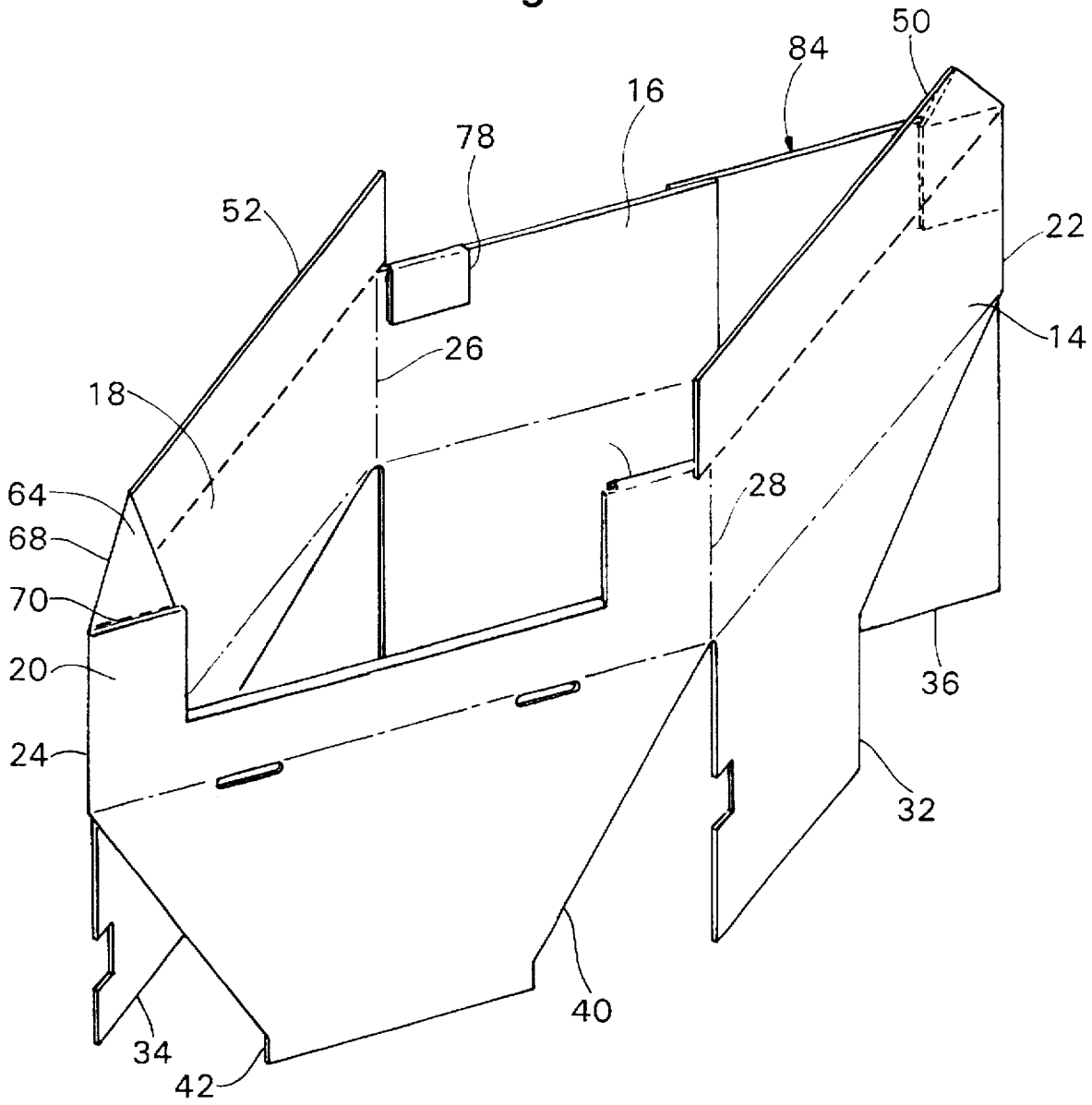
FIG. 5 is a perspective view of the knockdown of FIG. 3 shown partially opened.

Referring to FIGS. 3, 4, and 5, knockdown 84 has a first flat wall 86 and a second flat wall 88 attached to each other at the first folded corner 22 and the second folded corner 24 as shown. These folded corners correspond to the same folded corners 22 and 24 of container 10 shown in FIGS. 1 and 2. The flat walls 86 and 88 include the side panels 12 that will form the final container 10. In the illustrated embodiment, the first flat wall 86 includes the first and fourth side panels 14 and 20, and side flap 32 and front flap 40 all in a substantially same plane. It is understood that "substantially same plane" does not mean exactly the same plane. Likewise, the second flat wall 88 includes side panels 16 and 18 and bottom flaps 34 and 36 all in a substantially same plane. The rollover section 46 of front panel 20 is shown folded for forming the display opening 44.

Shelf members 50 and 52 are shown in their flat knockdown position, the longitudinal flat sections 58 of each shelf being in the substantially same planes as the respective side panels 14 and 18 to which they are attached, and the pull-down members 54, 56 being in the substantially same plane as respective side panels 16 and 20 to which they are attached. The pull-down members 54, 56 are shown folded from their respective shelves 50, 52 along fold lines 68 extending at an angle from the folded corners 22, 24, respectively, to facilitate the folding of the shelves into the flat position of the knockdown 84.

To assemble the knockdown 84 into the display-ready container 10, the two knockdown walls 86 and 88 are pushed apart, folding the flat walls 86 and 88 to form the corners 26 and 28 and create the basic shape of the container 10 (see FIG. 5 showing the knockdown 84 partially opened). The container bottom 30 is then assembled by interlocking the bottom forming flaps.

It is seen that as the side panel 14 opens away from the side panel 16, the pull-down member 54 attached to side panel 16 pulls the shelf member 50 into position as shown in FIG. 1. Similarly, the pull-down member 56 attached to side panel 20 pulls the shelf member 52 into position as the side panel 18 opens away from side panel 20. The fold lines 68 and 70 facilitate the opening of the knockdown by allowing the pull-down members to fold as necessary.

A blank 90 made in accordance with the present invention from which the knockdown 84 and container 10 can be made is illustrated in FIG. 6. The blank 90 is oriented to show the inside surface 92 of the container 10. The blank 90 includes the side panels 12, the first, third, and fourth side panels 14, 18, 20 as shown, and partial panels **16*a* and 16*b* which are secured together to form the complete second side panel 16 of the container 10. The side panels 12 are separated by score lines (crease) 94 impressed into the blank 90 where shown to act as a fold line to aid in folding. The bottom forming flaps 32, 34, 36*a*, 36*b* and 40 are integrally attached to the side panels with score lines 94** to aid in folding.

The rollover section 46 is formed by cuts 96 and fold lines 48 formed by scoring about which the rollover section can be folded to form the opening 44 in the container 10.

Shelves 50, 52 are integrally attached to the side panels 14 and 18, respectively, at fold lines 98 to aid in folding. In the illustrated embodiment, the fold lines 98 are formed with a series of perforations having a ¾" cut×⅜ land (crease).

The pull sections 64 and tabs 66 of the pull-down members 54, 56 are integral parts of the shelves 50, 52. Fold lines 68 and 70 defining the pull section 64 and glue tab 66 comprise ¼"×¼" perforations for aiding the folding process. Providing pull-down members 54 and 56 as integral parts of their respective shelves 50 and 52, and providing perforated fold lines defining these members is believed to add rigidity to the shelf structure and add structural strength to the container 10.

The reinforcing panels 76 and 78 are separated from the shelves 50 and 52, respectively, by a cut 100, and scored and cut for forming the ledge 80 of the container 10 as previously discussed.

The blank 90 can be formed from any material suitable for use as a container, including corrugated board and chipboard. A single die cut piece of corrugated board as shown in FIG. 6 is preferable for the illustrated embodiment. Any suitable type of score, creases, perforations, etc., may be used for the fold lines shown.

The blank 90 is readily assembled into the knockdown 84 by folding pull-down members 54 and 56 (having pull section 64 and tab 66) along fold lines 68 onto the inside surface 92 of the blank 90. The reinforcing panels 76 and 78 are folded and glued to the side panels 20 and **16*b*, respectively, and the rollover section 46 is folded and glued to the inside of the lower portion of the fourth side panel 20. Next, the side panels 16*b* and 18 and bottom forming flaps 36*b* and 34 are folded as a single flat unit about the corner 24 onto the inside face 92 of the blank 90. The partial panel 16*a* and partial bottom flap 36*a* are then folded as a flat unit about corner 22 onto the outside surface of partial panels 16*b* and 36*b* and glued thereto to form the full panel 16 and back flap 36, and thereby form the second flat wall 88 shown in FIG. 4. It is seen that partial panel 16*a* is thereby positioned over the glue tab 66 of pull-down member 54 and glued thereto, and the glue tab 66 of pull-down member 56 is likewise glued to the side panel 20. This assembly process creates the finished knockdown having flat walls 86 and 88 as shown in FIGS. 3 and 4**, which is ready to be bundled with other knockdowns and shipped to the user.

The rollover section 46 of the present embodiment is folded and glued during manufacture of the container 10 as described above to form the display opening 44. Alternatively, the rollover section 46 can be left in its unfolded position, to be folded into place during assembly of the knockdown into the container 10 by the user as known in the art. However, it is beneficial to form the display opening during manufacture of the knockdown which can ideally be done by machine. This avoids an additional folding step during assembly of the container normally done by hand, and minimizes the potential problems of carpal tunnel syndrome.

Figure 8:
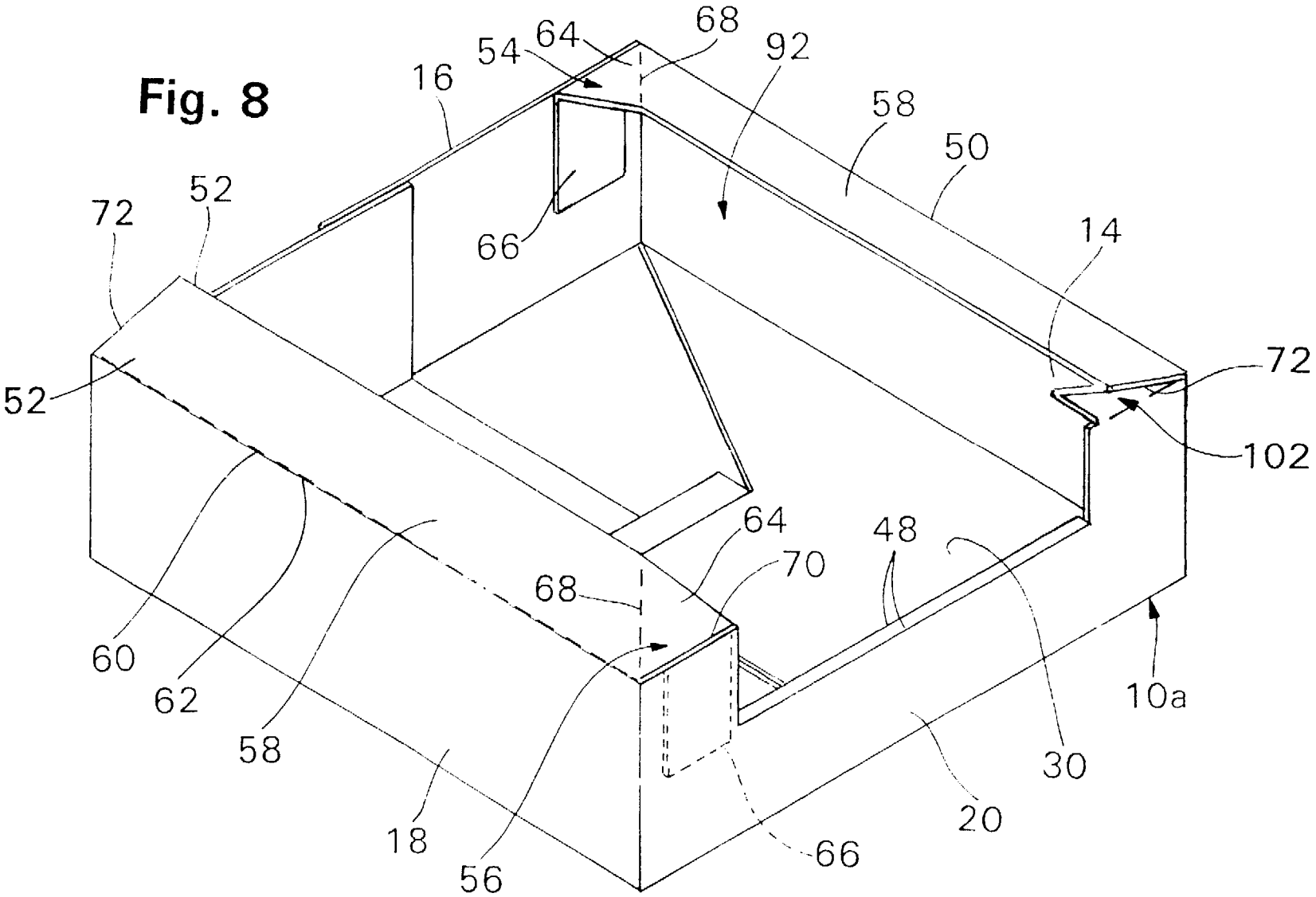
FIG. 8 is a perspective view of a second embodiment of the present invention.
Figure 9:
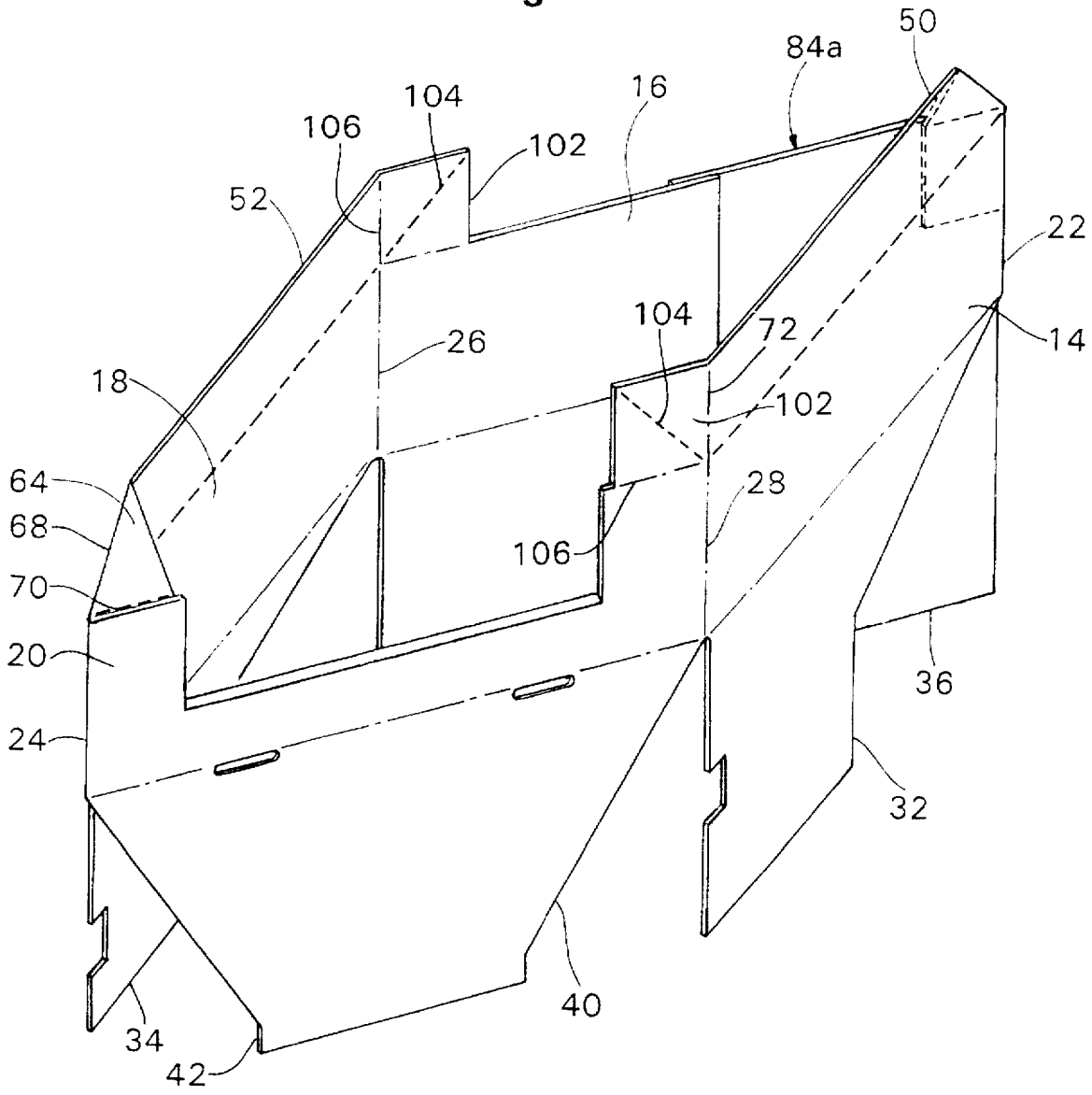
FIG. 9 is a perspective view of a knockdown shown partially opened which can be assembled into the container shown in FIG. 8.

A second preferred embodiment of the invention is now described with reference to FIGS. 8 and 9. A container **10*a* is shown similar in construction to the container 10 of FIGS. 1, 2 and 5**, with the same elements being identified by the respective same reference numerals.

Unlike the container 10 of FIGS. 1 and 2, the container **10*a* has shelf member ends 72 connected to the side panels to provide additional strength and support of the shelves 50 and 52. In the illustrated embodiment, this connection takes the form of intermediate folding panels 102 connecting the shelf ends 72 of shelf members 50 and 52 to respective side panels 20 and 16 as shown. Each intermediate panel 102 of the present embodiment has a fold line 104 (FIG. 9) about which the panel 102 folds when the container 10*a* is opened from its knockdown state to form an inverted corner fold as shown in FIG. 8. The fold line 104 takes the form of a series of perforations in the illustrated embodiment. It is seen that the fold line 104 promotes the folding of the intermediate panels 102 to allow the shelves 50, 52 to move into their substantially perpendicular shelf position as shown in FIG. 8**.

Figure 10:
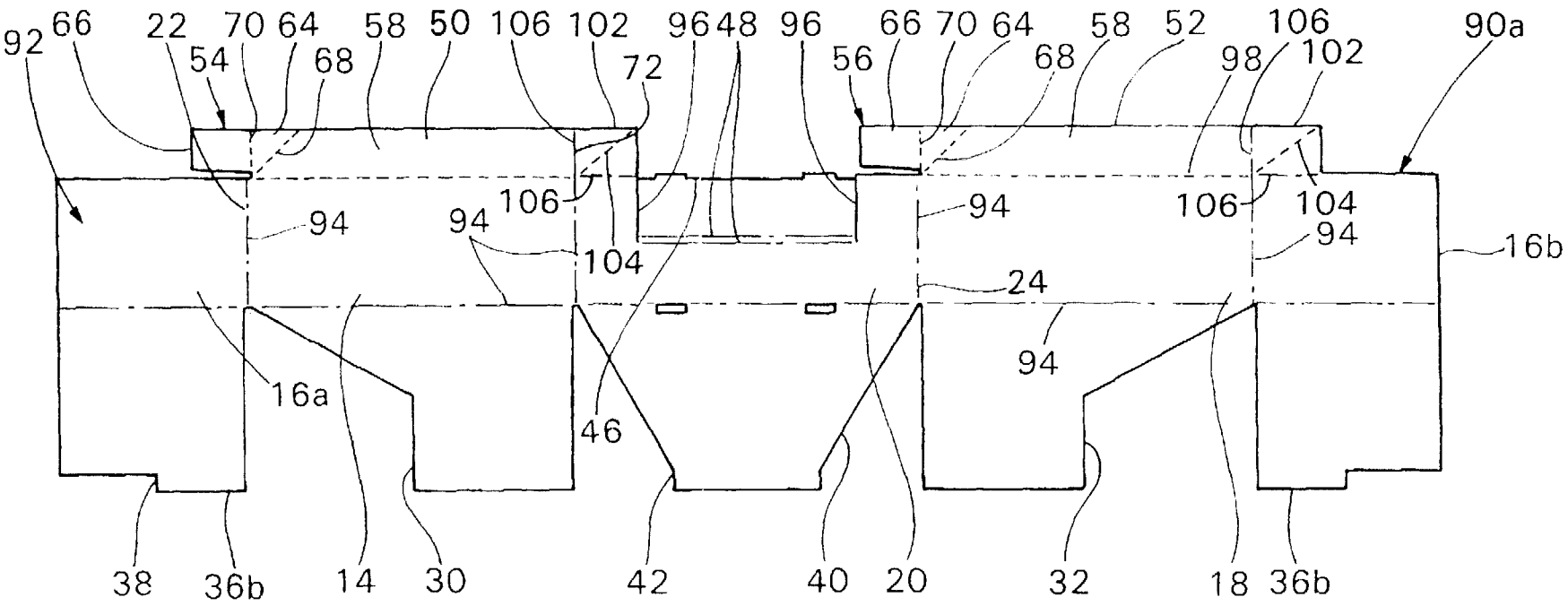
FIG. 10 is a plan view of a blank for forming the container shown in FIG. 8.

A blank **90*a* from which the knockdown 84*a* and container 10*a* can be made is illustrated in FIG. 10. The blank 90*a* is similar to the blank 90 shown in FIG. 6. The blank 90*a* includes the intermediate folding panels 102 having fold lines 104 as shown. The intermediate panels 102 are integrally attached to shelf member 50 and 52 and the respective side panels 20 and 16 as shown. Score lines 106 aid the folding of intermediate panels 102 relative the shelves 50, 52 and side panels 20, 16. The blank 90*a* is formed into the knockdown 84*a* and opened into the container 10*a* in a similar manner as described previously for container 10**.

While particular embodiments of the invention are described herein, it is not intended to limit the invention to such disclosure. Changes and modifications may be incorporated and embodied within the scope of the appended claims. For example, the illustrated embodiments show pull-down members integrally formed with the flat section of the shelf. Those skilled in the art readily recognize that the pull-down member can take on different forms and may not necessarily be an integral part of the shelf.

Those skilled in the art will also recognize that the present invention is not limited to the illustrated blanks. Other types of blanks may include other bottom styles, other display opening styles or no display opening at all, and may include fold line means between panels and for defining the pull-down member other than those described. Furthermore, the particular shapes of the various panels and shelf components may be modified. Finally, the designation of "first", "second", etc., for the various panels is not limited to the particular uses herein, e.g., "fourth side panel" as the "front panel".

What is claimed is:

1. A container comprising:

multiple side panels attached to one another to form container sides, said side panels including a first, second, third and fourth side panel, said first and second side panels attached to one another at a first folded corner, said third and fourth side panels attached to one another at a second folded corner;

a container bottom attached to said multiple side panels;

a shelf attached to the top of said first side panel;

wherein the container has a knockdown state having first and second flat knockdown walls attached to one another at said first and said second folded corners forming a substantially flat assembly, wherein said first knockdown wall comprises said first and fourth side panels in a substantially same plane and said second knockdown wall comprises said second and third side panels in a second substantially same plane; and a pull-down member attaching said shelf to said second side panel to pull said shelf into an approximately perpendicular position relative to said first side panel when said container is assembled from the knockdown state.

2. A container in accordance with claim 1 further comprising:

a second shelf attached to the top of said third side panel; and a second pull-down member attaching said second shelf to said fourth side panel to pull said second shelf into an approximately perpendicular position relative to said third side panel when said container is assembled from the knockdown state.

3. A container in accordance with claim 1 wherein said shelf has a lip extending over the top of said fourth side panel to provide additional support for said shelf.

4. A container in accordance with claim 1 wherein said shelf is connected to said fourth-side panel to provide additional support for said shelf.

5. A container in accordance with claim 1 wherein said pull-down member is an integral extension of said shelf.

6. A container in accordance with claim 5 wherein said shelf comprises a flat section attached to said first side panel, and a fold line separating said flat section from said pull-down member.

7. A container in accordance with claim 6 wherein said flat section is the approximate same length as said first side panel and is attached along its length to said first side panel.

8. A container in accordance with claim 4 further comprising an intermediate folding panel connecting said shelf to said fourth side panel.

9. A container in accordance with claim 6 wherein said pull-down member comprises a pull section attached at one end to said flat section and separated therefrom by said fold line, and a glue tab attached to the other end of said pull section separated therefrom by a second fold line and which is attached to said second side panel.

10. A container in accordance with claim 1 further comprising a reinforcing panel secured to the inside face of said fourth panel and positioned to support said shelf.

11. A container in a accordance with claim 1 further comprising a display opening formed by folding and gluing a rollover section cut from one of said side panels to an inside face of said one said side panel.

12. A container in accordance with claim 7 wherein said flat section and said first side panel are integral.

13. A container in accordance with claim 1 wherein said container comprises corrugated board.

14. A knockdown which can be assembled into a container having first, second, third, and fourth container side panels, the knockdown comprising:

a first flat wall including said first and fourth container side panels attached at their ends and in a substantially same plane;

a second flat wall including said second and third container side panels attached at their ends and in a second substantially same plane;

first and second folded corners whereat said first and second walls are attached to one another to form the knockdown, said first and said second container side panels attached to one another at said first folded corner, said third and fourth container side panels attached to one another at said second folded corner;

a shelf attached to the top of said first container side panel; and a pull-down member attaching said shelf to said second container side panel and positioned to pull said shelf into an approximately perpendicular position relative to said first side panel when the knockdown is assembled into the container.

15. A knockdown in accordance with claim 14 further comprising:

a second shelf attached to the top of said third container side panel; and a second pull-down member attaching said second shelf to said fourth container side panel and positioned to pull said second shelf to a substantially perpendicular position relative said third container side panel when the knockdown is assembled into the container.

16. A knockdown in accordance with claim 14 wherein said pull-down member is an integral extension of said shelf separated therefrom by a fold line.

17. A knockdown in accordance with claim 16 wherein said pull-down member comprises a pull section attached to the shelf at said fold line, and a glue tab attached to said second container side panel and separated from said pull section by a second fold line.

18. A knockdown in accordance with claim 14 wherein said shelf has a lip extending over the top of said fourth container side panel.

19. A knockdown in accordance with claim 15 wherein said shelf comprises a flat section attached to said first container side panel along the entire length of said first container side panel.

20. A knockdown in accordance with claim 14 herein said shelf is connected to said fourth side panel.

21. A knockdown in accordance with claim 14 comprising a display opening in said fourth container side panel, said display opening formed by folding a section of said fourth container side panel and gluing it to the inside face of the remaining section of said fourth container side panel.

22. A blank for forming a container, comprising:

a first side panel;

a first partial side panel integrally connected to the first side panel;

a second partial side panel which is securable to said first partial side panel to form a second side panel of the container;

a third side panel integrally attached to the second partial side panel;

a fourth side panel integrally attached to said third and first side panels;

bottom forming flaps integrally attached to the blank;

a shelf integrally attached to the top of said first side panel; and a pull-down member integrally attached to said shelf and extending over said first partial side panel.

23. A blank in accordance with claim 22 further comprising an intermediate panel connecting said shelf to said fourth side panel.

24. A blank in accordance with claim 23 wherein the pull-down member comprises a substantially triangular shaped pull piece separated from said shelf by a fold line, and a glue tab attached to the pull piece.

25. A container assembled from a knockdown state which has first and second flat knockdown walls attached to one another at first and second folded corners and positioned face-to-face to form a substantially flat assembly, said container comprising:

multiple side panels attached to one another to form the sides of the container, said side panels including first and second side panels connected to each other at said first folded corner, and third and fourth side panels connected to each other at said second folded corner, wherein said first knockdown wall includes said first and fourth side panels, and said second knockdown wall includes said second and third side panels;

a bottom panel attached to said multiple side panels to form the container bottom;

a shelf integrally attached to the top of said first side panel, said shelf having one side end connected to said fourth side panel;

a pull-down member having one end integrally extending from a second side end of said shelf, and another end secured to said second side panel and positioned to pull said shelf into a substantially perpendicular position relative said first side panel when said container is assembled from the knockdown state.

26. A container in accordance with claim 25 further comprising an intermediate folding panel connecting said shelf to said fourth side panel.

27. A container in accordance with claim 25 wherein said second side panel is a back panel and said fourth side panel is a front panel of the container.

28. A container in accordance with claim 25 further comprising a fold line having perforations between said shelf and said first side panel.

* * * * *